US006907937B2

(12) United States Patent
Whanger et al.

(10) Patent No.: US 6,907,937 B2
(45) Date of Patent: Jun. 21, 2005

(54) EXPANDABLE SEALING APPARATUS

(75) Inventors: Ken Whanger, Houston, TX (US); John Vicic, Spring, TX (US); Christopher Cuffe, The Woodlands, TX (US); Clayton Plucheck, Tomball, TX (US); Patrick G. Maguire, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/328,708

(22) Filed: Dec. 23, 2002

(65) Prior Publication Data

US 2004/0118572 A1 Jun. 24, 2004

(51) Int. Cl.[7] ..... E21B 33/00
(52) U.S. Cl. ..... 166/387; 166/208
(58) Field of Search ..... 166/378, 208, 166/212, 217, 207, 277, 380, 382, 387

(56) References Cited

U.S. PATENT DOCUMENTS

| | | | | |
|---|---|---|---|---|
| 2,306,160 | A | 12/1942 | Freyssinet | 288/6 |
| 2,519,116 | A | 8/1950 | Crake | 166/10 |
| 2,656,891 | A | 10/1953 | Toelke | 166/13 |
| 2,814,517 | A | 11/1957 | Razdow | 288/20 |
| 2,945,541 | A | 7/1960 | Maly et al. | 166/187 |
| 3,147,016 | A | 9/1964 | Traufler | 277/226 |
| 3,385,367 | A | 5/1968 | Kollsman | 166/191 |
| 3,593,799 | A | 7/1971 | Boughton et al. | 166/295 |
| 3,677,987 | A | 7/1972 | Pence, Jr. | 260/29.6 |
| 3,690,375 | A | 9/1972 | Shillander | 166/187 |
| 3,740,360 | A | 6/1973 | Nimerick | 260/17.4 |
| 3,918,523 | A | 11/1975 | Stuber | 166/285 |
| 4,078,606 | A | 3/1978 | Montgomery | 166/120 |
| 4,137,970 | A | 2/1979 | Laflin et al. | 166/292 |
| 4,253,676 | A | 3/1981 | Baker et al. | 277/34.6 |
| 4,300,775 | A | 11/1981 | Ringel | 277/34.3 |
| 4,403,660 | A | 9/1983 | Coone | 166/387 |
| 4,406,469 | A | 9/1983 | Allison | 277/123 |

(Continued)

FOREIGN PATENT DOCUMENTS

| | | | |
|---|---|---|---|
| EP | 0 237 662 | 9/1987 | E21B/34/10 |
| WO | WO 02/20941 | 3/2002 | E21B/33/128 |
| WO | WO 02/059452 | 8/2002 | E21B/33/00 |

OTHER PUBLICATIONS

U.S. Appl. No. 10/443,442, filed May 22, 2003, Whanger et al.
U.S. Appl. No. 10/317,843, filed Dec. 12, 2002, Whanger et al.
U.S. Appl. No. 10/255,571, filed Sep. 26, 2002, Stephenson.
U.S. Appl. No. 10/034,592, filed Dec. 28, 2001, Lauritzen et al.
U.K. Search Report, Application No. GB 0329659.7, dated Feb. 27, 2004.

*Primary Examiner*—Frank Tsay
(74) *Attorney, Agent, or Firm*—Moser, Patterson & Sheridan

(57) ABSTRACT

The present invention generally relates to an apparatus for sealing a wellbore. The sealing apparatus includes an expandable tubular body having one or more sealing elements disposed thereon. In one aspect, the sealing elements include swelling and non-swelling sealing elements. Preferably, the swelling sealing elements are made of a swelling elastomer capable of swelling upon activation by an activating agent. The swelling elements may be covered with a protective layer during the run-in. When the tubular body is expanded, the protective layer breaks, thereby exposing the swelling elements to the activating agent. In turn, the swelling elements swell and contact the wellbore to form a fluid tight seal.

29 Claims, 6 Drawing Sheets

U.S. PATENT DOCUMENTS

| | | | | | |
|---|---|---|---|---|---|
| 4,452,463 | A | | 6/1984 | Buckner | 277/120 |
| 4,457,369 | A | | 7/1984 | Henderson | 166/125 |
| 4,601,498 | A | | 7/1986 | Haugen | 285/332.3 |
| 4,633,950 | A | | 1/1987 | Delhommer et al. | 166/295 |
| 4,662,450 | A | | 5/1987 | Haugen | 166/299 |
| 4,674,570 | A | | 6/1987 | Jackson | 166/187 |
| 4,730,670 | A | | 3/1988 | Kim | 166/134 |
| 4,762,179 | A | | 8/1988 | Wesson et al. | 166/297 |
| 4,836,940 | A | | 6/1989 | Alexander | 252/8.512 |
| 4,862,967 | A | | 9/1989 | Harris | 166/387 |
| 4,886,117 | A | | 12/1989 | Patel | 166/187 |
| 4,907,651 | A | | 3/1990 | Bou-Mikael | 166/114 |
| 4,913,232 | A | | 4/1990 | Cheymol et al. | 166/285 |
| 4,919,989 | A | | 4/1990 | Colangelo | |
| 4,936,386 | A | | 6/1990 | Colangelo | |
| 5,086,841 | A | | 2/1992 | Reid et al. | 166/295 |
| 5,165,703 | A | | 11/1992 | Morvant | 277/188 |
| 5,226,492 | A | | 7/1993 | Solaeche P. et al. | 166/196 |
| 5,271,469 | A | | 12/1993 | Brooks et al. | 166/387 |
| 5,309,993 | A | | 5/1994 | Coon et al. | 166/115 |
| 5,311,938 | A | | 5/1994 | Hendrickson et al. | 166/134 |
| 5,511,620 | A | | 4/1996 | Baugh et al. | 166/387 |
| 5,605,195 | A | | 2/1997 | Eslinger et al. | 166/387 |
| 5,623,993 | A | | 4/1997 | Van Buskirk et al. | 166/292 |
| 5,676,384 | A | | 10/1997 | Culpepper | 277/188 |
| 5,687,748 | A | * | 11/1997 | Conrad et al. | 131/291 |
| 5,749,585 | A | | 5/1998 | Lembcke | 277/116.2 |
| 5,787,987 | A | | 8/1998 | Forsyth et al. | 166/313 |
| 5,803,178 | A | | 9/1998 | Cain | 166/306 |
| 5,833,001 | A | | 11/1998 | Song et al. | 166/287 |
| 5,875,847 | A | | 3/1999 | Forsyth | 166/313 |
| 5,941,313 | A | | 8/1999 | Arizmendi | 166/387 |
| 6,009,951 | A | | 1/2000 | Coronado et al. | 166/387 |
| 6,041,858 | A | | 3/2000 | Arizmendi | 166/187 |
| 6,073,692 | A | | 6/2000 | Wood et al. | 166/187 |
| 6,431,282 | B1 | * | 8/2002 | Bosma et al. | 166/288 |
| 6,446,717 | B1 | | 9/2002 | White et al. | 166/187 |
| 6,561,227 | B2 | * | 5/2003 | Cook et al. | 138/98 |
| 6,662,876 | B2 | * | 12/2003 | Lauritzen | 166/380 |
| 6,698,517 | B2 | * | 3/2004 | Simpson et al. | 166/277 |
| 6,702,029 | B2 | * | 3/2004 | Metcalfe et al. | 166/378 |

* cited by examiner

EXPANDABLE SEALING APPARATUS

BACKGROUND OF THE INVENTION

1. Field of the Invention

The present invention generally relates to a downhole tool for use in a wellbore. More particularly, the invention relates to a downhole tool for isolating a wellbore. More particularly still, the invention relates to an expandable tubular having an expandable or swelling sealing element for isolating a wellbore.

2. Description of the Related Art

In the drilling of oil and gas wells, a wellbore is formed using a drill bit that is urged downwardly at a lower end of a drill string. After drilling a predetermined depth, the drill string and bit are removed, and the wellbore is typically lined with a string of steel pipe called casing. The casing provides support to the wellbore and facilitates the isolation of certain areas of the wellbore adjacent hydrocarbon bearing formations. The casing typically extends down the wellbore from the surface of the well to a designated depth. An annular area is thus defined between the outside of the casing and the earth formation. This annular area is filled with cement to permanently set the casing in the wellbore and to facilitate the isolation of production zones and fluids at different depths within the wellbore.

Generally, it is desirable to provide a flow path for hydrocarbons from the surrounding formation into the newly formed wellbore. Typically, perforations are formed in the casing at the anticipated depth of hydrocarbons. The perforations are strategically formed adjacent the hydrocarbon zones to limit the production of water from water rich zones close to the hydrocarbon rich zones.

However, a problem arises when the cement does not adhere to the wellbore properly to provide an effective fluid seal. The ineffective seal allows water to travel along the cement and wellbore interface to the hydrocarbon rich zone. As a result, water may be produced along with the hydrocarbons.

One attempt to solve this problem is to employ a downhole packer to isolate specific portions of the wellbore. The downhole packer may be installed as an open-hole completion to isolate a portion of the wellbore and eliminate the need of cementing the annular area between the casing and the wellbore of the isolated portion. Typically, the downhole packer may be formed as an integral member of the existing casing and installed adjacent the desired production zone.

More recently, expandable tubular technology has been applied to downhole packers. Generally, expandable technology enables a smaller diameter tubular to pass through a larger diameter tubular, and thereafter expanded to a larger diameter. In this respect, expandable technology permits the formation of a tubular string having a substantially constant inner diameter. Accordingly, an expandable packer may be lowered into the wellbore and expanded into contact with the wellbore. By adopting the expandable technology, the expandable packer allows a larger diameter production tubing to be used because the conventional packer mandrel and valving system are no longer necessary.

However, one drawback of the downhole or expandable packers is their lack of gripping members on their outer surfaces. Consequently, the outer surfaces of these conventional packers may be unable to generate sufficient frictional contact to support their weight in the wellbore. Additionally, the expandable packer may not provide sufficient seal load to effectively seal the annular area between the expanded packer and the wellbore.

There is a need, therefore, for a packer having a sealing element that will effectively seal a portion of a tubular or a wellbore. There is a further need for a packer that will not reduce the diameter of the wellbore. Further still, there is a need for a sealing assembly that will effectively isolate a zone within a tubular or a wellbore.

SUMMARY OF THE INVENTION

The present invention generally relates to an apparatus for sealing a wellbore. The sealing apparatus includes an expandable tubular body having one or more sealing elements disposed thereon. In one aspect, the sealing elements include swelling and non-swelling sealing elements. Preferably, the swelling sealing elements are made of a swelling elastomer capable of swelling upon activation by an activating agent. The swelling elements may be covered with a protective layer during the run-in. When the tubular body is expanded, the protective layer breaks, thereby exposing the swelling elements to the activating agent. In turn, the swelling elements swell and contact the wellbore to form a fluid tight seal.

In another aspect, an apparatus for completing a well is provided. The apparatus includes an expandable tubular having a first sealing member and a second sealing member. Each sealing member has a tubular body and one or more swelling elements disposed around an outer surface of the tubular body.

In another aspect still, the present invention provides a method for completing a well. The method involves running a sealing apparatus into the wellbore. The sealing apparatus includes a tubular body and a swelling element disposed around an outer surface of the tubular body. The sealing apparatus is expanded to cause the swelling element to swell and contact the wellbore.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
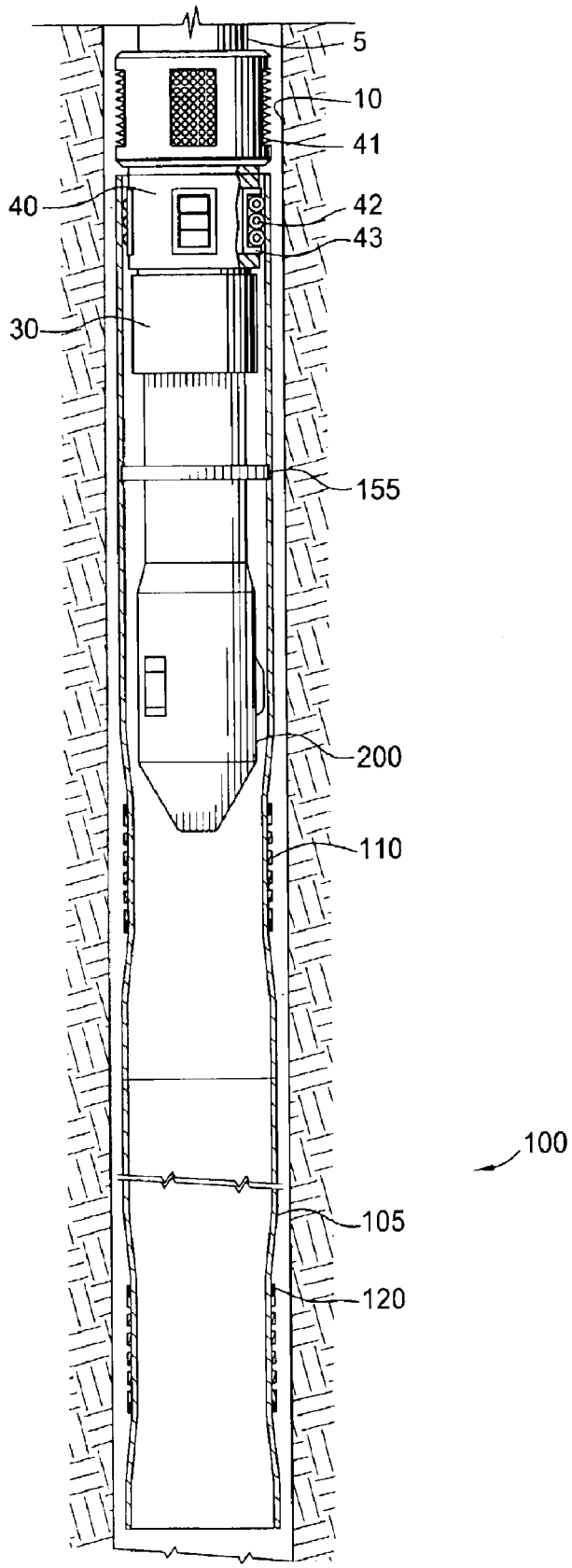
FIG. 1 is a view of an exemplary sealing assembly according to aspects of the present invention disposed in a wellbore.

FIG. 1 is a cross-sectional view of a sealing assembly 100 having an expandable tubular body 105, an upper sealing apparatus 110, and a lower sealing apparatus 120 according to aspects of the present invention. The sealing assembly 100 is disposed in an open hole vertical wellbore 10. It should be noted that aspects of the present invention are not limited to an open hole wellbore application, but are equally applicable to a cased wellbore or a tubular, as well as horizontal and deviated wellbores.

As illustrated in FIG. 1, the sealing assembly 100 and an expander tool 200 are lowered into the wellbore 10 on a work string 5. The work string 5 may provide hydraulic fluid from the surface to the expander tool 200 and various components disposed on the work string 5. The work string 5 includes a collet 155 for retaining the sealing assembly 100 during the run-in operation.

A torque anchor 40 may be disposed on the working string 5 to prevent rotation of the sealing assembly 100 during the expansion process. FIG. 1 shows the torque anchor 40 in the run-in position. In this view, the torque anchor 40 is in an unactuated position in order to facilitate run-in of the sealing assembly 100 and the expander tool 200. The torque anchor 40 defines a body having one or more sets of slip members 41, 42 radially disposed around its perimeter. In one embodiment, four sets of upper slip members 41 are employed to act against the wellbore 10 and four sets of lower slip members 42 are employed to act against the sealing assembly 100. Preferably, the upper slip members 41 have teeth-like gripping members disposed on an outer surface, while the lower slip members 42 have one or more wheels designed with sharp edges (not shown) to prevent rotational movement of the torque anchor 40. Although wheels and teeth-like slip mechanisms 42, 41 are presented in the FIG. 1, other types of slip mechanisms may be employed with the torque anchor 40 without deviating from the aspects of the present invention.

The torque anchor 40 is run into the wellbore 10 on the working string 5 along with the expander tool 200 and the sealing assembly 100. In the run-in position, the slip members 41, 42 are retracted within the housing 43, because the sealing assembly 100 is retained by the collet 155. Once the sealing assembly 100 has been lowered to the appropriate depth within the wellbore 10, the torque anchor 40 is activated. Fluid pressure provided from the surface through the working string 5 forces the upper and lower slip members 41, 42 outward from the torque anchor body 40. The upper slip members 41 act against the inner surface of the wellbore 10, thereby placing the torque anchor 40 in frictional contact with the wellbore 10. Similarly, the lower slip members 42 act against an inner surface of the sealing assembly 100, thereby placing the torque anchor 40 in frictional contact with the sealing assembly 100. This activated position is depicted in FIG. 5. In the activated position, the torque anchor 40 is rotationally fixed relative to the wellbore 10.

As shown in FIG. 1, an expander tool 200 provided to expand the sealing assembly 100 is disposed on the working string 5. The expander tool 200 may be operatively coupled to a motor 30 to provide rotational movement to the expander tool 200. The motor 30 is disposed on the work string 5 and may be hydraulically actuated by a fluid medium being pumped through the work string 5. The motor 30 may be a positive displacement motor or other types of motor known in the art. Although a rotary expander tool 200 is disclosed herein, other types of expander tools such as a cone-shaped mandrel are also applicable according aspects of the present invention.

Figure 2:
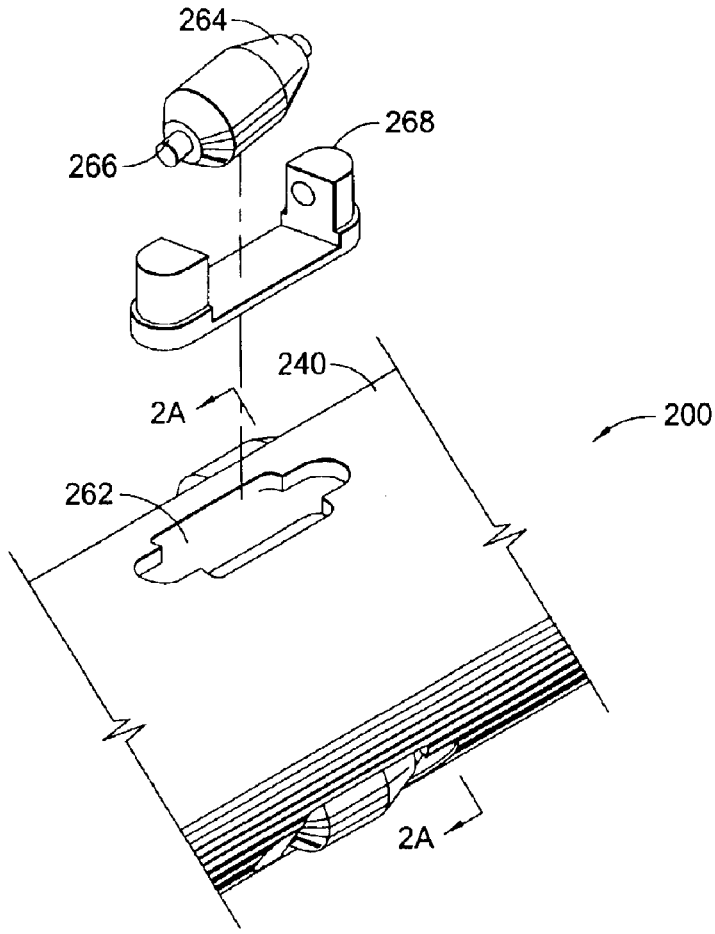
FIGS. 2 and 2A are cross-sectional views illustrating an expander tool provided to expand the liner assembly shown in FIG. 1.
Figure 2A:
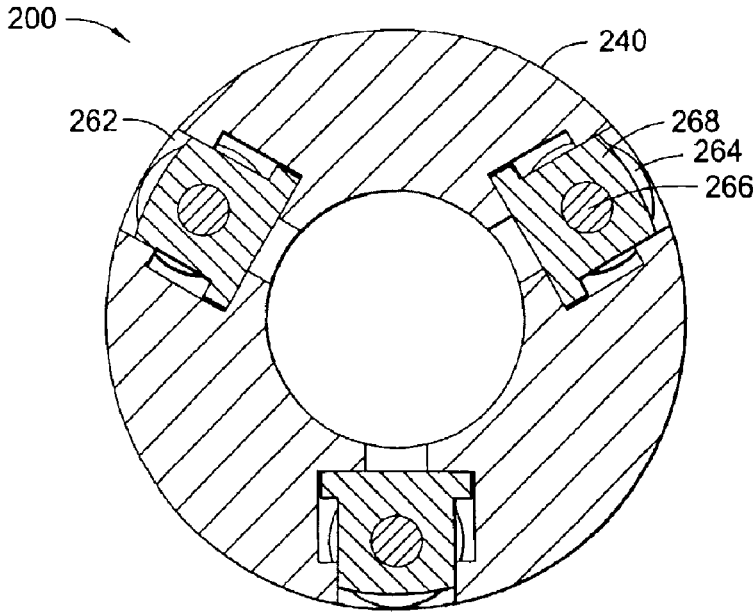

FIG. 2 is a sectional view of an exemplary expander tool 200. FIG. 2A presents the same expander tool 200 in cross-section, with the view taken across line 2A—2A of FIG. 2.

As illustrated in FIG. 2, the expander tool 200 has a central body 240 which is hollow and generally tubular. The central body 240 has a plurality of windows 262 to hold a respective roller 264. Each of the windows 262 has parallel sides and holds a roller 264 capable of extending radially from the expander tool 200. Each of the rollers 264 is supported by a shaft 266 at each end of the respective roller 264 for rotation about a respective rotational axis. Each shaft 266 is formed integral to its corresponding roller 264 and is capable of rotating within a corresponding piston 268. The pistons 268 are radially slidable, each being slidably sealed within its respective radially extended window 262. The back side of each piston 268 is exposed to the pressure of fluid within the annular space between the expander tool 200 and the work string 5. In this manner, pressurized fluid supplied to the expander tool 200 may actuate the pistons 268 and cause them to extend outwardly into contact with the inner surface of the sealing assembly 100. Additionally, the expansion tool 200 may be equipped with a cutting tool (not shown) to cut the sealing assembly 100 at a predetermined location. The cutting tool may be used to release the expanded portion of the sealing assembly 100 from the torque anchor 40 so that the work string 5 and the expander tool 200 may be removed from the wellbore 10 after expansion is completed.

Figure 3:
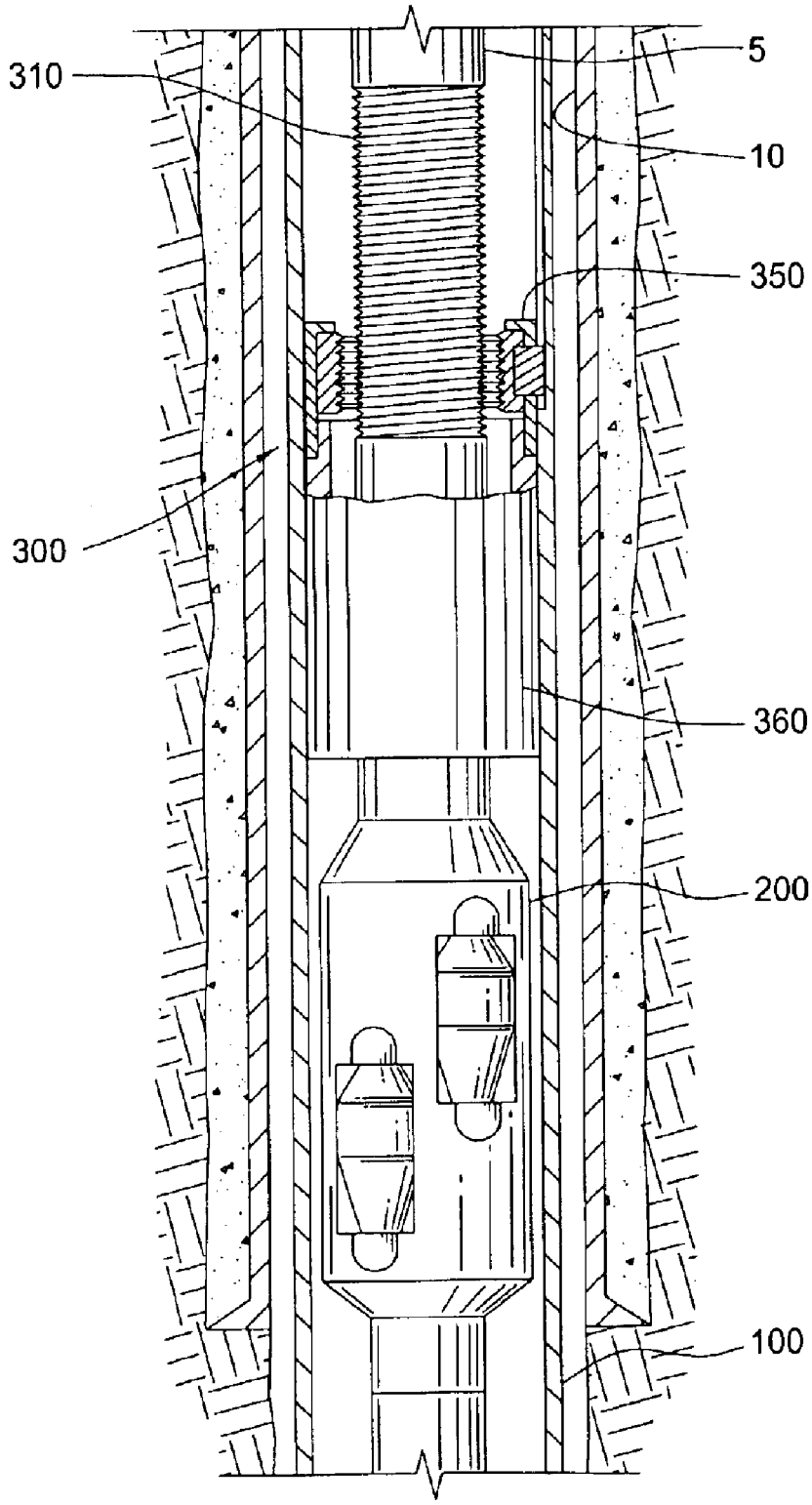
FIG. 3 is a cross-sectional view illustrating a translational tool applicable for axially translating the expander tool in the wellbore.

The expander tool 200 may include an apparatus for axially translating the expander tool 200 relative to the sealing assembly 100. One exemplary apparatus 300 for translating the expander tool 200 is disclosed in U.S. patent application Ser. No. 10/034,592, filed on Dec. 28, 2001, which application is herein incorporated by reference in its entirety. In one aspect, the translating apparatus 300 includes helical threads 310 formed on the work string 5 as illustrated in FIG. 3. The expander tool 200 may be operatively connected to a nut member 350 which rides along the threads 310 of the work string 5 when the work string 5 is rotated. The expander tool 200 may further include a recess 360 connected to the nut member 350 for receiving the work string 5 as the nut member 350 travels axially along the work string 5. The expander tool 200 is connected to the nut member 350 in a manner such that translation of the nut member 350 along the work string 5 serves to translate the expander tool 200 axially within the wellbore 10.

In one embodiment, the motor 30 illustrated in FIG. 1 may be used to rotate the work string 5. The work string 5 may further include one or more swivels (not shown) to permit the rotation of the expander tool 200 without rotating other tools downhole. The swivel may be provided as a separate downhole tool or incorporated into the expander tool 200 using a bearing-type connection (not shown).

The sealing assembly 100 shown in FIG. 1 may be expanded to isolate a portion of the wellbore 10. The sealing assembly 100 may include an expandable tubular 105 disposed between an upper sealing apparatus 110 and a lower sealing apparatus 120. Examples of the expandable tubular 105 include expandable solid tubulars, expandable slotted tubulars, expandable screens, and other forms of expandable tubulars known to a person of ordinary skill in the art. Further, the expandable tubular 105 may include one or more tubulars connected end to end. Isolation of the wellbore 10 may have applications such as shutting off production from a formation or preventing loss of fluid in the wellbore 10 to the formation. Moreover, the expandable tubular 105 may include an expandable screen to filter formation fluids entering the wellbore 10.

As shown, each sealing apparatus 110, 120 is connected to one end of the expandable liner 105. In this respect, the sealing apparatus 110, 120 are designed as separate components that may be easily attached to an expandable tubular 105 as needed. However, it must be noted that the sealing apparatus 110, 120 may also be formed directly on the expandable tubular 105 without deviating from the aspects of the present invention. Although only two sealing apparatus are described in the present embodiment, aspects of the present invention are equally applicable with one or more sealing apparatus. In the embodiment shown, the upper sealing apparatus 110 and the lower sealing apparatus 120 are substantially similar and interchangeable. Therefore, the upper sealing apparatus 110 will be described below as the description relating to the upper sealing apparatus 110 is also applicable to the lower sealing apparatus 120.

Figure 4:
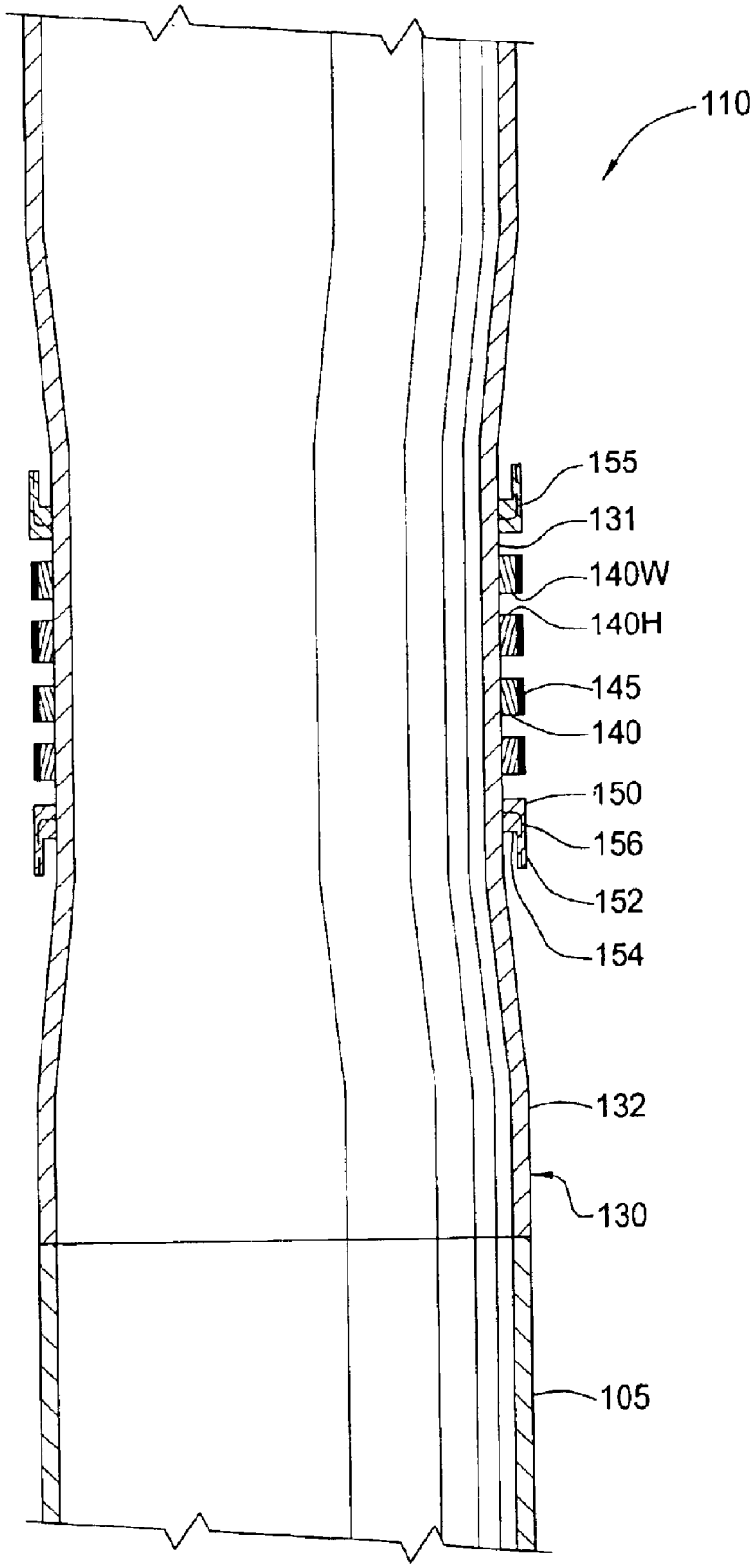
FIG. 4 shows an exemplary sealing apparatus according to aspects of the present invention.

FIG. 4 illustrates an exemplary sealing apparatus 110 according to aspects of the present invention. The sealing apparatus 110 includes a tubular body 130 having one or more sealing elements 140, 150 disposed around an outer portion 131 of the tubular body 130. Preferably, the sealing elements 140, 150 are disposed on a recessed outer portion 131 having a smaller outer diameter than a non-recessed portion 132 of the tubular body 130. In one embodiment, the combined outer diameter of the recessed portion 131 and the sealing elements 140, 150 is the same or less than the outer diameter of the non-recessed portion 132 of the tubular body 130. In this respect, the sealing elements 140, 150 may be disposed in the recessed portion 131 without substantially affecting the clearance required to move the sealing assembly 100 within the wellbore 10. In this manner, the outer diameter of the expandable sealing assembly 100 may be maximized, which, in turn, minimizes the amount of expansion necessary to install the expandable liner 105 in the wellbore.

The sealing elements used to isolate the wellbore 10 may include swelling sealing elements 140 and non-swelling sealing elements 150. In one embodiment, the swelling sealing elements 140 are made of a swelling elastomer that increases in size upon activation by an activating agent. Depending on the application, swelling elastomers may be selected to activate upon exposure to an activating agent such as a wellbore fluid, hydrocarbons, water, drilling fluids, non-hydrocarbons, and combinations thereof. An example of a swelling elastomer activated by hydrocarbons is neoprene. Examples of swelling elastomers activated by water include, but not limited to, nitrile and hydrogentated nitrile. Without limiting the aspects of the present invention to a certain activating mechanism, it has been found that activation occurs by way of absorption of the activating agent by the swelling elastomers. In turn, the absorption causes the polymer chains of the swelling elastomers to swell radially and axially. It must be noted that different types of swelling elastomers activated by other forms of activating agents are equally applicable without departing from the aspects of the present invention. Further, swelling elastomers described herein as being hydrocarbon activated or water activated are not limited to elastomers activated solely by hydrocarbon or water, but may encompass elastomers that exhibit a faster swelling rate for one activating agent than another activating agent. For example, swelling elastomers classified as hydrocarbon activated may include elastomers activated by either hydrocarbon or water. However, the hydrocarbon activated swelling elastomer display a faster swelling rate when exposed to hydrocarbon than water.

The swelling elements 140 may be disposed on the tubular body 130 in many different arrangements. Preferably, multiple rings of swelling elements 140 are arranged around the recessed portion 131. However, a single ring of swelling element 140 is also contemplated. In one embodiment, alternate rings of hydrocarbon activated swelling elements 140H and water activated swelling elements 140W are disposed on the tubular body 130 as illustrated in FIG. 4. To accommodate the swelling upon activation, each swelling element 140 may be spaced apart from an adjacent swelling element 140. The distance between adjacent elements 140 may be determined from the extent of anticipated swelling. In another embodiment, the swelling elements 140 may include only hydrocarbon activated swelling elastomers 140H or water activated swelling elastomers 140W. In another embodiment still, each element may include alternate layers of hydrocarbon 140H or water 140W activated swelling elastomers. For example, a layer of hydrocarbon activated swelling elastomers 140H may be disposed on top of a layer of water activated swelling elastomers 140W. The upper layer of swelling elastomers 140H may include pores or ports for fluid communication between the lower layer of swelling elastomers 140W and the activating agent.

The swelling elements 140 may be covered with a protective layer 145 to avoid premature swelling prior to reaching the desired location in the wellbore 10. Preferably, the protective layer 145 is made of a material that does not swell substantially upon contact with the activating agent. Further, the protective layer 145 should be strong enough to avoid tearing or damage as the sealing assembly 100 is run-in the wellbore 10. On the other hand, the protective layer 145 should break or tear upon expansion of the sealing apparatus 110, 120 by the expander tool 200 in order to expose the swelling elastomers 140 to the activating agent. In one embodiment, the protective layer 145 may include mylar, plastic, or other material having the desired qualities of the protective layer 145 as disclosed herein.

Non-swelling sealing elements 150 may be placed at each end of the swelling sealing elements 140 to contain and control the direction of swelling. In one embodiment, the non-swelling sealing elements 150 include a pair of non-swelling lip seals 150 as illustrated in FIG. 4. Preferably, the non-swelling lip seals 150 are made of an elastomeric material. The lip seals 150 include a flexible member 152 extending from the base portion 154 of the lip seal 150 and parallel to the body 130 of the sealing apparatus 110. The flexible member 152 may bend away from the sealing apparatus 110 toward the wellbore 10 when it encounters a force coming from the distal end of the flexible member 152. The flexible member 152 may provide additional seal load for the sealing apparatus 110 when it is actuated.

In another aspect, the non-swelling nature of the base portion 154 of the lip seal 150 serves to control the direction of expansion of the swelling elements 140. In this respect, the swelling elements 140 are allowed to expand axially relative to the wellbore 10 until they encounter the base portion 154. As such, the base portion 154 acts as barriers to axial expansion and limits further axial swelling of the swelling elements 140. As a result, the swelling elements 140 are limited to swelling radially toward the wellbore 10. In this manner, a substantial amount of swelling is directed toward the wellbore 10, thereby creating a fluid tight seal between the wellbore 10 and the sealing apparatus 110. Although a single directional lip seal 152 is disclosed herein, aspects of the present invention also contemplate the use of non-swelling elements 150 having no lip seals or a bi-directional lip seal.

In another aspect, the non-swelling elements 150 may include a reinforcement sheath 155 embedded therein. The reinforcement sheath 155 provides additional support to the flexible member 152 so that it may withstand stronger forces encountered in the wellbore 10. Preferably, the reinforcement sheath 155 is made of a thin, flexible, and strong material. Examples of the reinforcement sheath 155 include wire mesh, wire cloth, cotton weave, polyester, kevlar, nylon, steel, composite, fiberglass, and other thin, flexible, and other materials as is known to a person of ordinary skill in the art. In another embodiment, the reinforcement sheath 155 may be wrapped around a portion of the non-swelling elements 150.

Figure 6:
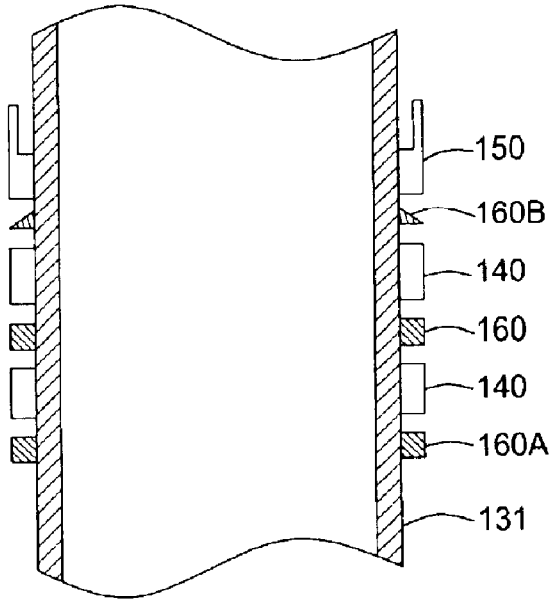
FIG. 6 illustrates a partial view of an embodiment of the sealing apparatus of the present invention.

In another aspect still, backup rings 160 may be disposed between the swelling sealing elements 150 to contain and control the direction of swelling as illustrated in FIG. 6. FIG. 6 is a partial view of the sealing apparatus 110 of the present invention. As shown, a backup ring 160 may be formed on each side of a swelling sealing element 150. Backup rings 160A and 160B illustrate two examples of the shapes in which the backup rings 160 may embody.

In operation, the sealing assembly 100 is lowered into the wellbore 10 and positioned adjacent the area of the wellbore 10 to be sealed off as illustrated in FIG. 1. Once in position, the torque anchor 40 is actuated to ensure the sealing assembly 100 does not rotate during the expansion operation. Thereafter, pressure is supplied to the expander tool 200 to extend the rollers 264 into contact with the inner surface of the sealing assembly 100. The pressure also actuates the motor 30, which begins rotating the expander tool 200 relative the sealing assembly 100. The combined actions of the roller extension and rotation plastically deform the sealing assembly 100 into a state of permanent expansion.

As the expander tool 200 translates axially along the sealing assembly 100, the recessed portion 131 and the non-recessed portion 132 of the sealing apparatus 110 are expanded to the same or substantially the same inner diameter as shown in FIG. 5. The expansion of the recessed portion 131 also expands the sealing elements 140, 150 disposed on the sealing apparatus 110. The expansion causes the protective layer 145 around the swelling sealing elements 140 to break, thereby exposing the swelling sealing elements 140 to the activating agents. As shown, the swelling sealing elements 140 include both hydrocarbon activated and water activated swelling elements 140H, 140W. The respective sealing elements 140H, 140W are activated by the hydrocarbon and water found in the wellbore 10. Once activated, the swelling elements 140 swell in both the radial and axial direction. However, axial swelling is limited by adjacent swelling elements 140 or the non-swelling elements 150. In this manner, a substantial amount of the swelling may be directed toward the wellbore 10 to create a strong, fluid tight seal.

Figure 5A:
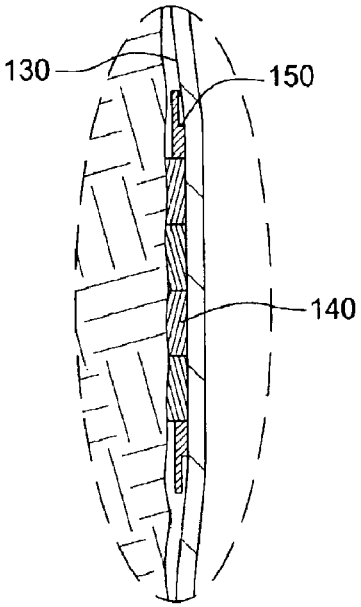
FIG. 5A is an enlarged view illustrating the sealing apparatus expanded by the expander tool and the swelling elements activated by the activating agents.
Figure 5:
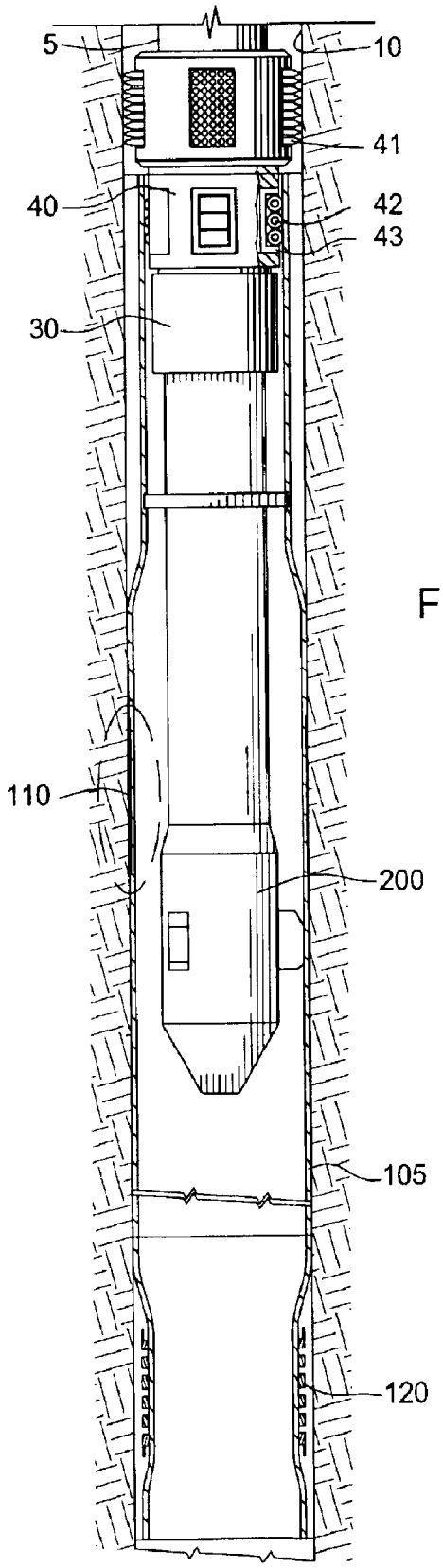
FIG. 5 is a cross-sectional view illustrating the expander tool expanding the liner assembly according to aspects of the present invention.

FIG. 5A is an exploded view of the recess portion 131 of the sealing apparatus 110 expanded in the wellbore 10. As shown, the swelling elements 140 have been activated to seal off the annular space between the wellbore 10 and the sealing assembly 100. It can also be seen that an increase in pressure in the wellbore 10 will cause the flexible portion 152 of the non-swelling elements 150 to bend toward the wellbore 10 to provide additional seal load to seal the wellbore 10.

After the sealing apparatus 110 has been expanded, the collet and the torque anchor 40 may be de-actuated, thereby releasing the expander tool 200 from the sealing assembly 100. In this respect, the expander tool 200 is free to move axially relative to the sealing assembly 100. The expander tool 200 may now be rotated by rotating the work string 5. The expansion process continues by moving the expander tool 200 axially toward the unexpanded portions of the sealing assembly 100. After the sealing assembly 100 has been fully expanded, the expander tool 200 is de-actuated and removed from the wellbore 10.

In another embodiment (not shown), the sealing assembly 100 may be expanded in sections. After the upper sealing apparatus 110 is expanded. The unexpanded portion of the sealing assembly 100 above the upper sealing apparatus 110 may be severed from the remaining portions of the sealing assembly 100. Thereafter, the torque anchor 40 may be de-actuated to free the expander tool 200. The expanded upper sealing apparatus 110 now serves to hold the sealing assembly 100 in the wellbore 10, thereby allowing the work string 5 to move axially in the wellbore 10. The work string 5 may now reposition itself in the wellbore 10 so that the expander tool 200 may expand the next section of the sealing assembly 100.

Figure 7:
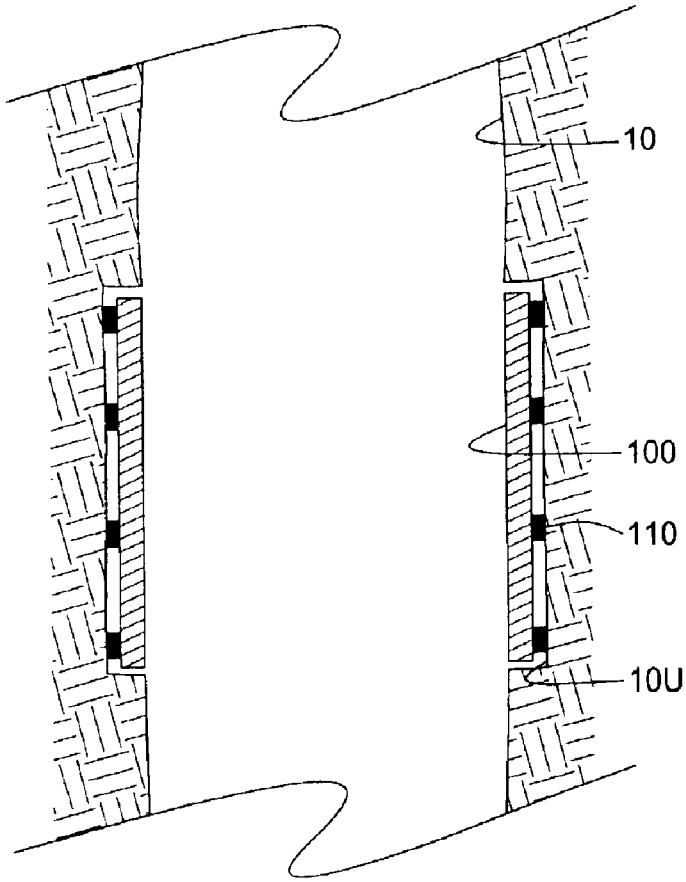
FIG. 7 illustrates a sealing apparatus installed in an under-reamed portion of a wellbore.

In another aspect, the sealing assembly 100 may be disposed in an under-reamed portion 10U of the wellbore 10 as illustrated in FIG. 7. Initially, a portion 10U of the wellbore 10 may be under-reamed to increase its inner diameter. The wellbore 10 may be under-reamed in any manner known to a person of ordinary skill in the art. Thereafter, the sealing assembly 100 may be expanded in the under-reamed portion 10U of the wellbore 10. An advantage to such an application is that the inner diameter of the sealing assembly 100 after expansion may be substantially equal to the initial inner diameter of the wellbore 10. As a result, the installation of the sealing assembly 100 will not affect the inner diameter of the wellbore 10.

FIG. 7 also shows the sealing assembly 100 having four sealing apparatus 110. As discussed earlier, the sealing assembly 100 may be equipped with any number of sealing apparatus 110 without deviating from the aspects of the present invention.

While the foregoing is directed to embodiments of the present invention, other and further embodiments of the invention may be devised without departing from the basic scope thereof, and the scope thereof is determined by the claims that follow.

We claim:

1. A sealing apparatus for isolating a tubular, comprising:

a tubular body having a recessed portion and a non-recessed portion;

one or more swelling elastomers disposed around an outer surface of the tubular body in the recessed portion; and a cover at least partially disposed on a portion of the one or more swelling elastomers.

2. The apparatus of claim 1, further comprising at least one non-swelling member disposed adjacent each end of the one or more swelling elastomers.

3. The apparatus of claim 2, wherein the one or more swelling elastomers and the at least one non-swelling member are disposed on the recessed portion of the outer surface of the tubular body.

4. The apparatus of claim 2, wherein the at least one non-swelling member includes a reinforcement sheath.

5. The apparatus of claim 1, wherein the one or more swelling elastomers are activated by a wellbore fluid.

6. The apparatus of claim 1, wherein the wellbore fluid is selected from the group consisting of water, hydrocarbon, and combinations thereof.

7. The apparatus of claim 1, wherein expanding the tubular body causes the cover to become more permeable to an activating agent.

8. The apparatus of claim 1, wherein the one or more swelling elastomers include at least one hydrocarbon activated swelling elastomer and at least one water activated swelling elastomer.

9. The apparatus of claim 1, wherein the tubular body comprises an expandable tubular body.

10. The apparatus of claim 1, wherein the cover substantially prevents the one or more swelling elastomers from activating.

11. The apparatus of claim 1, further comprising at least one non-swelling element having a flexible member capable of creating a pressurized seal upon activation of the sealing apparatus.

12. The apparatus of claim 1, wherein an outer surface of the elastomers does not extend outwards past the outer surface of the non-recessed portion of the tubular.

13. An apparatus for isolating a well, comprising:

an expandable tubular having a first sealing member and a second sealing member, wherein each of the sealing members include:

a tubular body having a recessed portion and a non-recessed portion; and one or more swelling elements disposed around an outer surface of the tubular body in the recessed portion.

14. A method for isolating a well, comprising:

running a sealing apparatus into the wellbore, the sealing apparatus including:

a tubular body; and a swelling element disposed on a recessed portion of the tubular body;

expanding the tubular body; and causing the swelling element to swell and contact the wellbore.

15. An apparatus for isolating a well, comprising:

an expandable tubular having a first sealing member and a second sealing member, wherein each of the sealing members include:

a tubular body having a recessed portion and a non-recessed portion;

one or more swelling elements disposed around an outer surface of the tubular body in the recessed portion; and at least one non-swelling element disposed adjacent each end of the one or more swelling elements.

16. The apparatus of claim 15, further comprising a protective layer disposed around the one or more swelling elements.

17. The apparatus of claim 16, wherein the protective layer substantially prevents the one or more swelling elastomers from activating.

18. The apparatus of claim 17, wherein expanding the tubular body causes the protective layer to become more permeable to an activating agent.

19. The apparatus of claim 15, wherein the one or more swelling elements and the at least one non-swelling element are disposed on the recessed portion of the outer surface of the tubular body.

20. The apparatus of claim 19, wherein the one or more swelling elements are activated by an agent selected from the group consisting of water, hydrocarbon, and combinations thereof.

21. The apparatus of claim 15, further comprising at least one non-swelling element having a flexible member capable of creating a pressurized seal upon activation of the apparatus.

22. A method for isolating a well, comprising:

running a sealing apparatus into the wellbore, the sealing apparatus including:

a tubular body comprising an expandable tubular; and a swelling element disposed on a recessed portion of the tubular body;

expanding the tubular body; and causing the swelling element to swell and contact the wellbore.

23. The method of claim 24, wherein the sealing apparatus further comprises a protective cover at least partially disposed on a portion of the swelling element.

24. The method of claim 23, wherein expanding the tubular body causes the protective cover to become more permeable to an activating agent.

25. The method of claim 22, wherein the sealing apparatus further comprises a non-swelling element disposed adjacent to the swelling element.

26. The method of claim 25, wherein the non-swelling element includes a reinforcement sheath.

27. The method of claim 22, further comprising exposing the swelling element to an activating agent.

28. The method of claim 22, wherein the swelling element comprises an elastomer.

29. The method of claim 22, wherein the swelling element swells when exposed to an activating agent.

* * * * *

UNITED STATES PATENT AND TRADEMARK OFFICE

CERTIFICATE OF CORRECTION

PATENT NO. : 6,907,937 B2
APPLICATION NO. : 10/328708
DATED : June 21, 2005
INVENTOR(S) : Ken Whanger et al.

It is certified that error appears in the above-identified patent and that said Letters Patent is hereby corrected as shown below:

In column 10, line 35, please delete [24] and insert --22--.

Signed and Sealed this

Twelfth Day of September, 2006

JON W. DUDAS
*Director of the United States Patent and Trademark Office*